US005326401A

United States Patent [19]

MacNaughton et al.

[11] Patent Number: 5,326,401

[45] Date of Patent: Jul. 5, 1994

[54] EMULSION COATER

[75] Inventors: George MacNaughton, Andover; Steven Forti, Norwell; Dietmar Stapelfeld, Marshfield, all of Mass.

[73] Assignee: Wearguard Corp., Norwell, Mass.

[21] Appl. No.: 937,500

[22] Filed: Aug. 28, 1992

[51] Int. Cl.[5] ..... B05C 3/00

[52] U.S. Cl. ..... 118/406; 101/119; 101/120

[58] Field of Search ..... 101/120, 119; 118/406, 118/410, 411

[56] References Cited

U.S. PATENT DOCUMENTS

| | | | |
|---|---|---|---|
| 3,949,667 | 4/1976 | Zimmer | 118/406 |
| 3,999,479 | 12/1976 | Zimmer | 118/406 |
| 4,090,443 | 5/1978 | Gasser | 118/406 |
| 4,313,289 | 12/1982 | Gasser | 118/404 |
| 4,509,455 | 4/1985 | Shirataki | 118/413 |
| 4,515,297 | 5/1985 | Schoenthaler | 427/96 |
| 4,622,237 | 11/1985 | Schoenthaler | 118/410 |
| 4,665,723 | 5/1987 | Zimmer | 118/406 |

*Primary Examiner*—W. Gary Jones
*Assistant Examiner*—Brenda Lamb
*Attorney, Agent, or Firm*—Lieberman & Nowak

[57] ABSTRACT

An emulsion coater apparatus for filling a screen with emulsion is described. A head delivers pressurized emulsion onto and through holes in a screen. Squeegees located on either side of the screen are then drawn across the screen's surface so as to remove excess emulsion and fill any holes not filled by the high pressure head. The emulsion coater apparatus coats a screen in a single pass, thus making the coating process more efficient. Moreover, dispersing emulsion under pressure alleviates the need to degrease the screen, saving costs and minimizing environmental damage.

10 Claims, 4 Drawing Sheets

EMULSION COATER

BACKGROUND OF THE INVENTION

The subject invention relates to an emulsion coater having a unique extrusion head which permits pneumatic pressure to uniformly extrude emulsion under pressure. This emulsion coater is particularly useful for filling the mesh in silkscreens used by the printing industry. Unlike conventional mesh coating techniques which rely to a large extent on gravity as the driving force, the subject invention uses a pressure head that effectively eliminates the need to degrease a screen, providing both the economic and environmental benefits of not requiring a detergent.

Application of emulsion to a screen is labor intensive. Accordingly numerous automated machines have been developed to expedite this process. Unfortunately, current automated processes are basically variations on the manual process employed for decades. In the manual process, emulsion is exposed to a screen and dragged upward so as to disburse the emulsion across the surface of the screen. Unfortunately, a single coating will not fill all holes in the screen. Accordingly, the screen must be reversed and the process repeated again on the back side. This double application must again be repeated 2–4 more times depending on screen material and density.

Emulsions tend to be viscous. As such, they are difficult to dispense and typically require multiple passes with a squeegee to be forced through a printing screen. Moreover, it has been difficult to attain even distribution of emulsion through the screen. To achieve the above objectives, various devices have been utilized, none of which have proved entirely satisfactory.

U.S. Pat. No. 2,793,587, issued May 28, 1957 to Childers, brings out the problems associated with the use of a squeegee. One major disadvantage is the inability to obtain uniform pressure along the entire length of the squeegee. Further, mechanically supported squeegees have a tendency to sag in their midsections, or require special and complex mechanical support means.

The U.S. Pat. No. 4,550,681 issued Nov. 5, 1985 to Zimmer, et al., describes an applicator for uniformly distributing a flowable material over a receiving surface. This applicator uses a channel system having a branch channel structure extending from an entrance port through a multiplicity of exit ports. The channels become progressively more numerous and correspondingly narrower toward the exit ports. By having a large entry port leading to progressively smaller and smaller exit ports, to cause even distribution of fluid through the exit ports.

Like Zimmer, et al., the subject invention seeks to obviate pressure fluctuations which tend to form unsightly streaks and irregularities in the dispensed fluid. However, unlike Zimmer, et al., the subject invention utilizes equalization chambers and a final cover plate beyond the exit ports which result in smooth, even, pressurized delivery of the viscous emulsion to both coat and permeate a screen. The use of sufficient pressure to force emulsion through a screen is not taught or suggested by Zimmer, et al. Beyond the novel pressure head, the subject invention further provides a complete system for coating a screen with emulsion.

SUMMARY OF THE INVENTION

The subject invention provides an emulsion coater apparatus having a head for delivering an emulsion under pressure onto a screen, means for moving the screen relative to the head, and means for removing excess emulsion from the screen.

The head preferably comprises an inlet for intaking pressurized emulsion, an equalization area sealably connected to the inlet, and a plurality of nozzles sealingly connected to the equalization area. Typically, the equalization area comprises a first and second equalization chamber sealingly connected via a plurality of passageways, with the first equalization chamber being sealingly connected to the inlet and the second equalization chamber being sealingly connected to the nozzles. To best equalize pressure, the inlet normally connects to the first equalization chamber at a central point and the passageways progressively increase in cross-section as the distance from the central point increases.

To form the emulsion as a continuous sheet, the head may further comprise a cover plate having a crevice therethrough, which is attached to the head in such a manner that emulsion exiting the nozzles passes through the crevice at a uniform pressure.

Means for moving the head relative to the screen usually comprise a motor driven chain and guide shafts which guide the head along a track. Means for removing excess emulsion most often comprise a plurality of squeegees. At least one squeegee contacts one side of the screen and at least one squeegee contacts the opposite side of the screen. The squeegees are moveable relative to the screen and come in contact with the screen as the emulsion is extruded. The assembly (squeegees and extruder head) moves in relation to the screen thereby spreading an even coat of emulsion.

A method of coating a screen with emulsion is also provided. This method entails extruding emulsion through the screen at a pressure sufficient to cause the emulsion to transverse the holes in the screen. The squeegees then remove excess emulsion from the screen.

Extruding normally comprises introducing pressurized emulsion into a head which distributes a line of emulsion at a generally uniform pressure along the length of the line. Removing typically comprises contacting the screen with a plurality of squeegees and moving the squeegees along the surface of the screen.

DETAILED DESCRIPTION OF THE INVENTION

Figure 1:
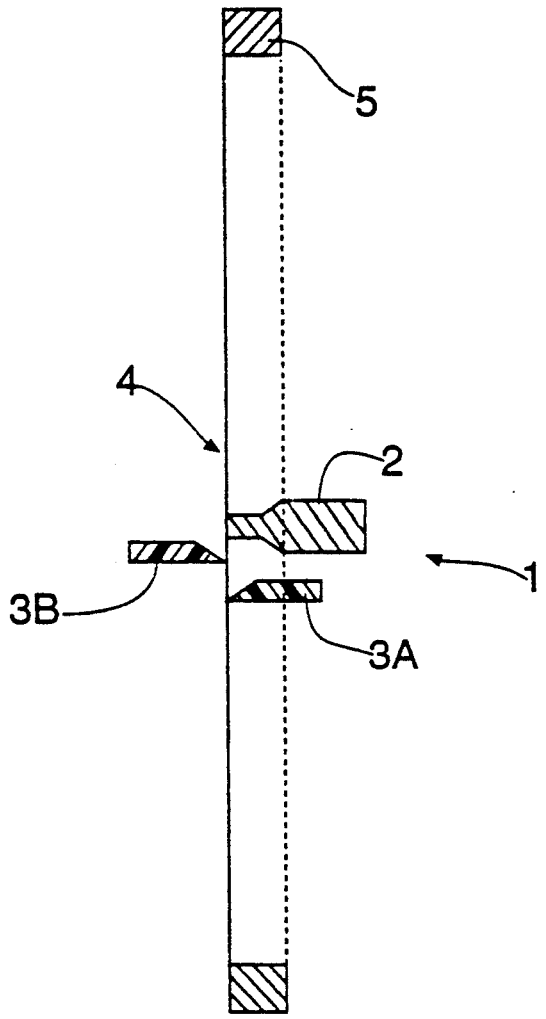
FIG. 1 depicts a schematic cross-sectional view of the subject emulsion coater apparatus.

Silk screening can be used to print art work, logos, writing, etc. on a wide variety of substrates. This process is accomplished by first stretching a piece of silk, synthetic or metallic screening material, and fastening it to a frame to secure it in a flat and taut condition. Emulsion is then applied to the screen to render the screen impervious to printing inks. To generate a pattern in the emulsion, emulsion is subjected to ultraviolet light in selected areas. The ultraviolet light acts to cure and harden the emulsion. Areas of the screen which are not treated with ultraviolet light may be rinsed with water causing the emulsion to wash out, and permitting printing ink to pass unimpeded through the screen in a predetermined pattern. With this in mind, the subject apparatus and method will be described in terms of their preferred embodiments.

The subject invention provides an emulsion coater apparatus (1) which utilizes an emulsion dispersing head (2) to extrude pressurized emulsion and includes means for removing excess emulsion which has been extruded through head (2). These means typically comprise a plurality of squeegees (3). For convenience head (2) and squeegees (3) are collectively referred to as the assembly. Typically, one squeegee (3A) is located on the same side of the screen (4) to be coated as pressure head (2). A second squeegee (3B) is mounted on the side of screen (4) opposite to that of pressure head (2). It should be noted that screen (4) is held in place by frame (5), the interior measurements of which should roughly correspond to the width of head (2).

As stated above, the width of head (2) should be approximately equal to the width of the interior opening in frame (5). One currently preferred frame has the dimensions 17 inches by 22 inches, requiring head (2) 15½ inches in length. The path traversed by head (2) should roughly correspond to the length of the interior opening in frame (5). Accordingly, there must exist means for moving screen (4) relative to head (2). In one embodiment, frame (5) is maintained steadfast by the use of a holding apparatus (not depicted). Such a holding apparatus is readily apparent to one skilled in the art and will not be described in detail. When a stationary holding apparatus is used, head (2) moves in a plane parallel to the surface of screen (4). Emulsion is exuded through head (2) while it is moving along the interior length of frame (5), thus producing a layer of emulsion that effectively coats and permeates the entire surface of screen (4). In another embodiment, head (2) is maintained at a fixed position and frame (5) is caused to move relative to head (2) so as to produce the same result.

Head (2) has inlet (21) into which pressurized emulsion is introduced. Typical pressures are from about 30 to about 60 pounds per square inch (psi). Such pressurization may be by any means known to those skilled in the art. The exact amount of pressure required will vary with head speed and mesh size, smaller holes and faster speeds necessitating greater pressures. Typically, the emulsion is pressurized by introducing a pressurized gas, such as air, into a sealed container containing emulsion to produce an emulsion that is dispersed at a constant, predetermined pressure. Pressurized emulsion transverses inlet (21) and enters equalization area (22).

Figure 2:
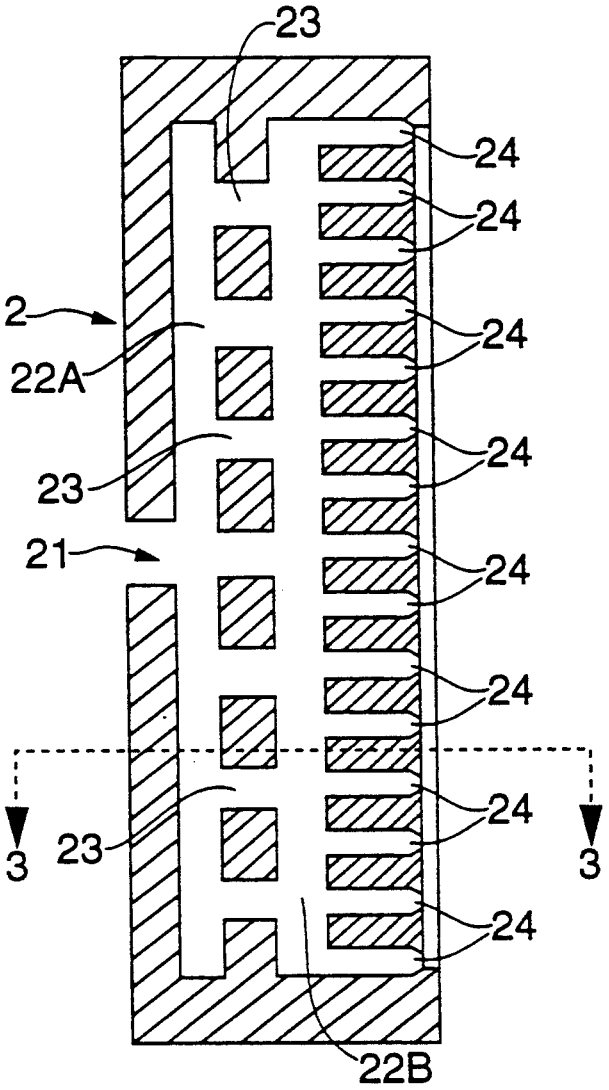
FIG. 2 illustrates a cross-sectional view of a pressure head usable with the subject apparatus.

In the embodiment depicted in FIG. 2, there are two equalization chambers (22A and 22B). In an embodiment where head (2) is 15½ inches in length, chamber (22A) would be approximately 15"×0.375"×0.15" and chamber (22B) would be approximately 15"×0.375"×0.1". These chambers are connected by a plurality of passageways (23). To best equalize pressure throughout head (2) across the entire length of equalization chamber (22B), it is preferred that individual passageways (23) increase in cross-sectional area the more distal from emulsion inlet (21), i.e., passageways (23) near the center of head (2) are of a more narrow bore than those passageways (23) farther from inlet (21). High pressure emulsion proximate to inlet (21), is afforded a passageway (23) of limited cross-sectional area (i.e., emulsion tends to move through equalization chamber (22A) in a direction perpendicular to inlet (21) rather than transversing passageway (23) at this point). As the pressure decreases distal to inlet (21), the cross-sectional areas of passageways (23) are corresponding larger so as to induce a constant flow through each of passageways (23). Any number of equalization chambers (22) and corresponding series of passageways (23) may be employed. The greater of number of equalization chambers (22) and passageways (23) utilized, the more uniform the final pressure in the emulsion. Further, by increasing the number of equalization chambers (22) and passageways (23), the pressure required in the emulsion at inlet (21) will decrease. The number and cross-sectional areas of passageways (23) are ready determinable based on fluid dynamics.

The physical makeup of pressure head (2) may be of any material which is not solubilized by the emulsion and which has suitable integrity to withstand the pressures encountered. Such materials include, but are not limited to cast metals, such as aluminum or iron, forged metals such as aluminum (e.g., a machined flat bar) or steel (e.g., carbon or stainless), plastics, resins or carbon materials (such as graphite or carbon fiber). Various means for connecting and fabricating high pressure applicators, are described in U.S. Pat. No. 4,550,681, issued Nov. 5, 1985 to Zimmer, et al., the contents of which is herein incorporated by reference.

Returning to FIG. 2, emulsion exits equalization chamber (22B) via a plurality of nozzles (24). In the 15½" length head (2) nozzles (24) would be approximately 0.187"×0.951"×0.061". In a preferred embodiment, nozzles (24) exit into cover plate (25) having a central crevice (26) located along its entire length. For the 15½" length head (2) crevice (26) would be approximately 15"×0.031". More generally, crevice (26) has a cross-section of approximately 0.03 to 0.04 inches and is of a length that approximates the width of frame (5). Uniformly pressurized emulsion is extruded throughout the entire length of crevice (26).

Figure 4:
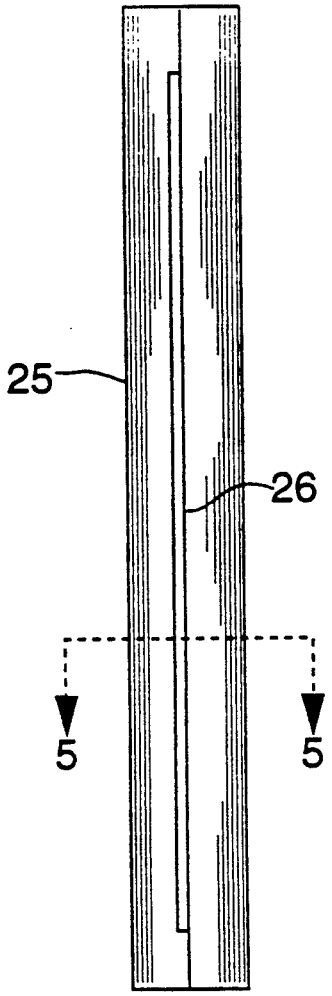
FIG. 4 shows a bottom view of a cover plate usable with the pressure head.
Figure 3:
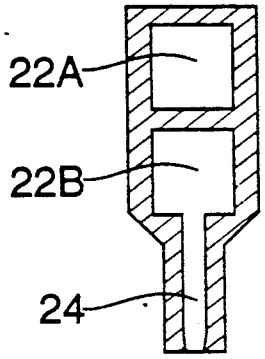
FIG. 3 shows a view of the pressure head taken along plane 3—3.
Figure 5:
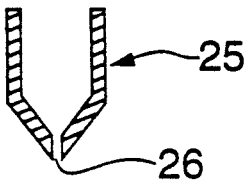
FIG. 5 shows a cross-sectional view of the cover plate taken along plane 5—5.

FIG. 3 shows a cross-sectional view taken along plane 3—3 of FIG. 2. As depicted, equalization chambers (22) are of greater volume than passageways (23). FIG. 4 shows a bottom view of cover plate (25) and FIG. 5 shows a view along plane 5—5 of the cover plate. The function of cover plate (25) is to form the emulsion as a continuous sheet. Such results may also be obtained by employing a multiplicity of nozzles (24) in the absence of coverplate (25).

Figure 6A:
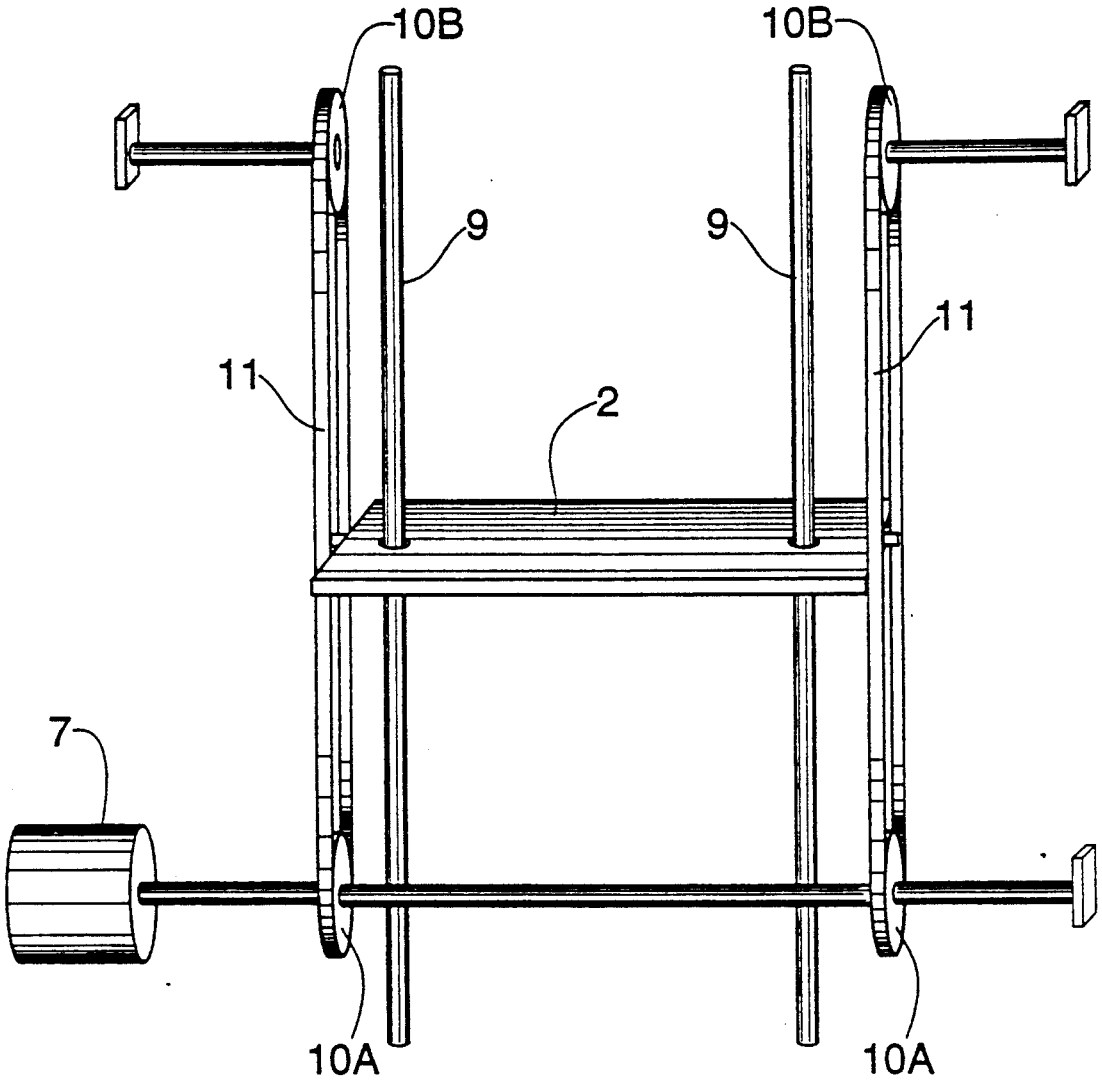
FIG. 6A shows a schematic depiction of a first means for moving the assembly.

FIG. 6A shows a pressure head (2) mounted on a pair of guide rods (9). Alternatively, a single eccentric, e.g. grooved, guide rod (9) may be used to maintain pressure head (2) in a plane parallel to screen (4). As depicted, motor (7) drives a pair of pulleys (10A) which each rotate a continuous belt or chain (11) which is supported at its distal end by a second pulley (10B). Typically, these pulleys (10) are sprockets which engage chain (11). Each belt or chain (11) is fixedly attached at a point to head (2). Movement of chains (11) causes head (2) to move along guide rods (9) in a plane parallel to screen (4).

Figure 6B:
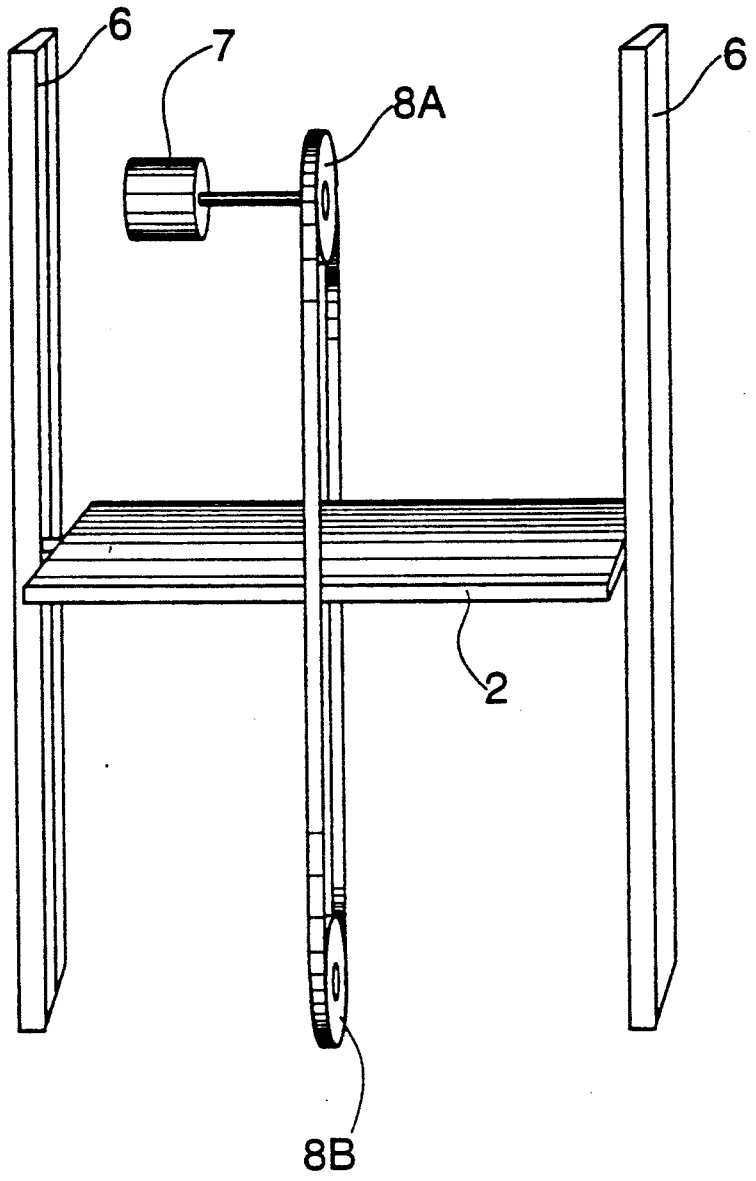
FIG. 6B shows a schematic depiction of a second means for moving the assembly.

FIG. 6B shows pressure head (2) mounted on a pair of tracks (6). Any means for guiding pressure head (2)

along a plane parallel to the surface of screen (4) is satisfactory and any means readily determinable to those skilled in the art may be employed. For example, pressure head (2) may be mounted upon a single guide rod which is eccentric, e.g. grooved, so as to minimize side-to-side oscillation of head (2), or may be mounted along a plurality of parallel rails (6). Movement of pressure head (2) along rails (6) may be accomplished by any means known to those skilled in the art. FIG. 6 shows a cable is connected to high pressure head (2) via a motor (7) and two pulleys (8A and 8B). However, other systems are envisioned, such as those using pneumatics to move pressure head (2) along rails (6).

The subject invention also provides a method of coating a screen with emulsion. This method basically comprises extruding emulsion onto screen (4) at a pressure sufficient to cause the emulsion to transverse the holes in screen (4) and removing excess emulsion from screen (4) using squeegees (3). Pressurized emulsion must be provided to head (2). Head (2) then acts to distribute a line of emulsion at a generally uniform pressure through crevice (26) and onto and through screen (4). This method may also entail providing means for moving screen (4) relative to head (2) (either head (2), screen (4) or both may be in motion) and means for removing excess emulsion from screen (4). Removing excess emulsion typically includes contacting screen (4) with a plurality of squeegees (3) and moving the squeegees along the surface of screen (4). Under normal circumstances squeegee (3A) is located on the same side of screen (4) as head (2) and squeegee (3B) is located on the opposite side of screen (4). The action of squeegees (3A and 3B) is such that they push emulsion through screen (4) to fill in any unfilled holes while floating excess emulsion down screen (4), where it can be readily removed.

Upon reading the subject patent application, alternative embodiments and variations will become obvious to those skilled in the art. These embodiments are to be considered within the scope and spirit of the subject invention. The subject invention is only to be limited by the claims which follow and their equivalents.

What is claimed is:

1. An emulsion coater apparatus comprising:
(a) a head for receiving a pre-pressurized emulsion, and delivering the emulsion at a pressure sufficient to cause the emulsion to traverse holes in a screen;
(b) means for moving the head relative to the screen; and
(c) means for removing excess emulsion from both sides of the screen.

2. An apparatus of claim 1, wherein the head comprises an inlet for intaking pressurized emulsion, an equalization area sealingly connected to the inlet, a plurality of nozzles sealingly connected to the equalization area, and a cover plate sealingly connected to the plurality of nozzles.

3. An apparatus of claim 2, wherein the equalization area comprises a first and second equalization chamber sealingly connected via a plurality of passageways, the first equalization chamber being sealingly connected to the inlet and the second equalization chamber being sealingly connected to the nozzles.

4. An apparatus of claim 3, wherein the inlet connects to the first equalization chamber at a central point and the passageways progressively increase in cross-section as the distance from the central point increases.

5. An apparatus of claim 2 further comprising a cover plate having a crevice therethrough, the cover plate being attached to the head in such a manner that emulsion exiting the nozzles passes through the crevice at a uniform pressure.

6. An apparatus of claim 1, wherein means for moving the head relative to the screen comprises a motor which moves the head.

7. An apparatus of claim 6, wherein the head is guided by a track along a plane generally parallel to the surface of the screen.

8. An apparatus of claim 1, wherein means for removing the excess emulsion comprise a plurality of squeegees.

9. An apparatus of claim 8, wherein at least one squeegee contacts one side of the screen and at least one squeegee contacts the opposite side of the screen.

10. An apparatus of claim 9, wherein the squeegees are moveable relative to the screen.

* * * * *